US008106299B2

(12) United States Patent
Elsmark

(10) Patent No.: US 8,106,299 B2
(45) Date of Patent: Jan. 31, 2012

(54) MULTI CONDUCTOR CABLE FOR A PORTABLE ELECTRIC TOOL

(75) Inventor: Karl Johan Lars Elsmark, Saltsjö-Boo (SE)

(73) Assignee: Atlas Copco Tools AB, Nacka (SE)

( * ) Notice: Subject to any disclaimer, the term of this patent is extended or adjusted under 35 U.S.C. 154(b) by 288 days.

(21) Appl. No.: 12/443,862

(22) PCT Filed: Sep. 27, 2007

(86) PCT No.: PCT/SE2007/000847

§ 371 (c)(1),
(2), (4) Date: Apr. 1, 2009

(87) PCT Pub. No.: WO2008/041902

PCT Pub. Date: Apr. 10, 2008

(65) Prior Publication Data

US 2010/0018746 A1 Jan. 28, 2010

(30) Foreign Application Priority Data

Oct. 2, 2006 (SE) ..... 0602038

(51) Int. Cl.
*H01B 7/00* (2006.01)

(52) U.S. Cl. ..... 174/110 R; 174/112; 174/113 R

(58) Field of Classification Search ..... 174/110 R, 174/113 R, 115, 120 R, 120 SR, 120 AR
See application file for complete search history.

(56) References Cited

U.S. PATENT DOCUMENTS

| | | | | |
|---|---|---|---|---|
| 3,665,374 | A * | 5/1972 | Denton | 219/256 |
| 3,867,006 | A * | 2/1975 | Jeffress | 439/455 |
| 4,359,597 | A * | 11/1982 | Paquin et al. | 174/34 |
| 4,449,012 | A | 5/1984 | Voser | |
| 4,474,431 | A * | 10/1984 | Bricheno | 385/24 |
| 4,822,128 | A * | 4/1989 | Imoto et al. | 385/43 |
| 5,750,932 | A | 5/1998 | Hansson | |
| 5,789,725 | A | 8/1998 | McIntire et al. | |
| 6,431,904 | B1 * | 8/2002 | Berelsman | 439/447 |
| 6,444,915 | B1 * | 9/2002 | Wang | 174/110 R |

FOREIGN PATENT DOCUMENTS

GB 2 241 374 A 1/1990

* cited by examiner

*Primary Examiner* — William Mayo, III
(74) *Attorney, Agent, or Firm* — Holtz, Holtz, Goodman & Chick, PC

(57) ABSTRACT

A multi conductor flat type cable, which is intended for connecting a portable electric power tool to a stationary power supply and operation control unit, has a connector plug (18) attached to its one end, wherein the cable (10) has a twisted shape section (A) adjacent the connector plug (18) for facilitating universal bending of the cable (10). The twisted section (A) is provided with a transition sleeve (16) with a cylindrical portion (17) at the connector plug end and two tapering tongues (20, 21) extending along the cable (10) over at least a part of the twisted section (A), wherein the cable (10) is adapted to the cylindrical shape of the connector plug (18) and strengthened against too close bending in the twisted section (A). The transition sleeve (16) is molded onto the cable (10) in a first manufacturing step, and in a second step the cable (10) together with the transition sleeve (16) are heated to a certain temperature and twisted to assume the twisted shape in the section (A).

3 Claims, 1 Drawing Sheet

MULTI CONDUCTOR CABLE FOR A PORTABLE ELECTRIC TOOL

CROSS-REFERENCE TO RELATED APPLICATIONS

This application is a U.S. National Phase Application under 35 USC 371 of International Application PCT/SE2007/000847 filed Sep. 27, 2007.

BACKGROUND OF THE INVENTION

1. Field of the Invention

The invention relates to a flat type multi conductor cable for connecting an electric power tool to a power supply and operation control unit. In particular the invention concerns a flat type multi conductor cable carrying at its one end a connector plug for connection to the power tool and comprising a twisted section for universal easy bending of the cable.

2. Description of Related Art

A power tool cable of the above type is previously described in U.S. Pat. No. 5,750,932. This cable is disadvantageous both in that it could be too closely bent adjacent the connector plug and thereby easily get damaged, and in that the flat shape in itself makes it difficult to get an acceptable connection with a standard type connector plug.

BRIEF SUMMARY OF THE INVENTION

The object of the invention is on one hand to provide a flat type multi conductor cable with a universal bending support adjacent the connector plug and to adapt the shape of the cable to standard type connector plugs, and on the other hand to create a method for providing a flat type cable with both an external transition sleeve and a twisted section for universal easy bending of the cable.

Further characteristic features and advantages of the invention will appear from the following specification.

A preferred embodiment of the invention is below described in detail with reference to the accompanying drawing.

DETAILED DESCRIPTION OF THE INVENTION

Figure 1:
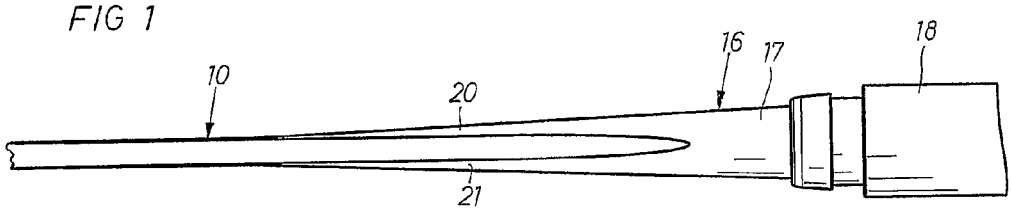
FIG. 1 shows a side view of a multi conductor cable according to the invention.
Figure 2:
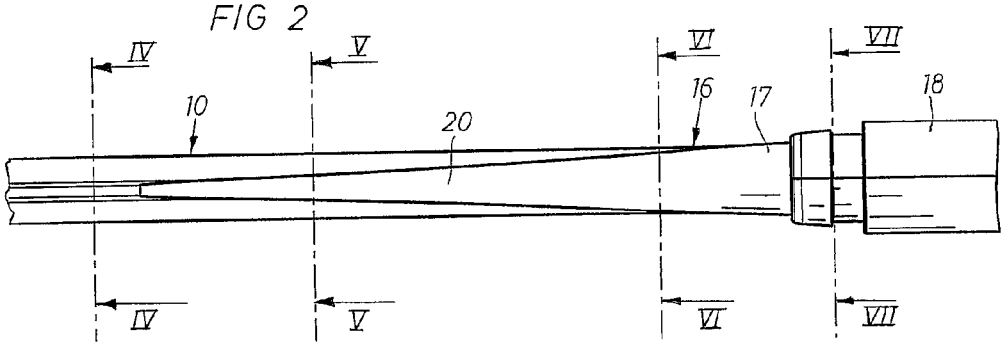
FIG. 2 shows a top view of the cable in FIG. 1.

The cable illustrated in the drawing figures comprises a flat type of cable 10 for connecting a power tool to a remotely located control unit and includes one section 11 with coarse conductors for power supply to the power tool, and another section 12 with tinier conductors for transfer of electrical signals between the power tool and the control unit. Between the two conductor sections 11, 12 there is provided a mechanical pulling load transferring string 15 of for instance Kevlar. In order to facilitate a universal bending of the cable and improve handling of the power tool the cable is preformed to twisted form over a section A adjacent the power tool. This type of cable is previously described in U.S. Pat. No. 5,750,932.

The problems mentioned in the preamble of the specification regarding adaptation of the flat cable 10 to a standard type cylindrical connector plug 18 and also to avoid too close bending of the cable 10 and a risk for damaging the cable are solved by providing the cable 10 adjacent its power tool end with a flexible transition sleeve 16 which has a cylindrical section 17 close to the connector plug 18 and two parallel tapering tongues 20, 21 extending along the cable 10 away from the connector plug 18 over the twisted section A.

Figure 4:
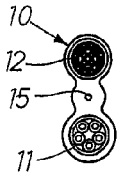
FIG. 4 shows a cross section along line IV-IV in FIG. 2.
Figure 5:
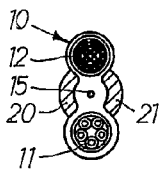
FIG. 5 shows a cross section along line V-V in FIG. 2.
Figure 6:
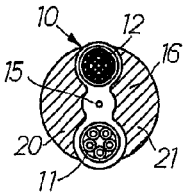
FIG. 6 shows a cross section along line VI-VI in FIG. 2.
Figure 7:
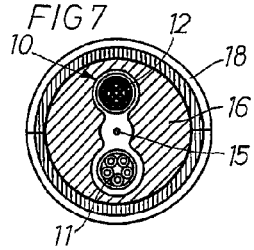
FIG. 7 shows a cross section along line VII-VII in FIG. 2.

By the cross section shown in FIG. 7 it is illustrated how the full circular cross section of the transition sleeve 16 adapts the flat cable 10 to the cylindrical connector plug 18, and in FIGS. 6-4 it is illustrated how the tongues 20, 21 of the transition sleeve 16 successively taper to finally in FIG. 4 have ended and left the flat cable 10 in its original shape. The tongues 20, 21 provide a successively increasing strengthening effect towards bending of the cable 10 the closer they get to the connector plug 18.

Figure 3:
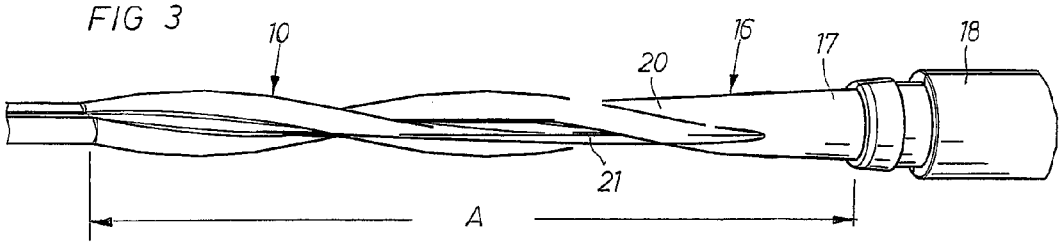
FIG. 3 shows a perspective view of the cable in FIGS. 1 and 2 after having been subjected to twisting.

In a first step of forming section A of the cable 10 the transition sleeve 16 is moulded onto the cable 10 as the latter is still in a straight untwisted shape, whereafter in a second step the section A of the cable 10 together with the transition sleeve 16 are heated to a certain temperature and exposed to a twisting force. When resuming normal temperature the section A of the cable 10 and the transition sleeve 16 assume a permanently twisted shape as illustrated in FIG. 3.

The invention claimed is:

1. A multi conductor cable having a substantially flat shape for connecting a portable electric power tool to a power supply operation control unit, comprising:

a connector plug attached to one end of the cable for connecting the cable to the power tool;

a twisted section provided close to the connector plug for facilitating universal bending of the cable; and an external flexible transition sleeve connected to the cable adjacent to the connector plug end of the cable;

wherein said transition sleeve has a length extending over at least a part of the twisted section; and wherein said transition sleeve comprises a cylindrical section provided at the connector plug end of the cable and two parallel tongues which extend from the connector plug and which taper along the cable over at least a part of the twisted section.

2. The cable according to claim 1, wherein said transition sleeve is molded onto the originally flat cable.

3. A method for providing an originally flat multi conductor cable with an easily bendable twisted section, and an external flexible transition sleeve, as claimed in claim 1, comprising:

molding said transition sleeve onto the cable; and heating the cable and the transition sleeve to a certain temperature and together exposing them to a twisting force so as permanently form said twisted section.

* * * * *